US008449719B2

(12) United States Patent
Camus et al.

(10) Patent No.: US 8,449,719 B2
(45) **Date of Patent: *May 28, 2013**

(54) SECURITY PAPER

(75) Inventors: Michel Camus, Rives sur Fure (FR); Stephane Mallol, Provins (FR); Ivan Thierry, Jouy sur Morin (FR); Pierre Doublet, Saint Brice (FR)

(73) Assignee: Arjowiggins Security, Paris (FR)

( * ) Notice: Subject to any disclaimer, the term of this patent is extended or adjusted under 35 U.S.C. 154(b) by 50 days.

This patent is subject to a terminal disclaimer.

(21) Appl. No.: 12/810,359

(22) PCT Filed: Dec. 19, 2008

(86) PCT No.: PCT/FR2008/052387

§ 371 (c)(1),
(2), (4) Date: Jan. 3, 2011

(87) PCT Pub. No.: WO2009/083689

PCT Pub. Date: Jul. 9, 2009

(65) Prior Publication Data

US 2011/0142279 A1 Jun. 16, 2011

(30) Foreign Application Priority Data

Dec. 28, 2007 (FR) ..... 07 60413

(51) Int. Cl.
*D21F 1/44* (2006.01)

(52) U.S. Cl.
USPC ..... 162/110

(58) Field of Classification Search
USPC ..... 162/110, 103, 104, 108, 140; 283/72, 283/82, 83, 91, 94, 111, 113; 428/195.1; 235/487, 488
See application file for complete search history.

(56) References Cited

U.S. PATENT DOCUMENTS

| | | | |
|---|---|---|---|
| 5,068,008 | A | 11/1991 | Crane |
| 5,176,405 | A | 1/1993 | Kaule et al. |
| 6,402,888 | B1 | 6/2002 | Doublet et al. |
| 6,616,803 | B1 * | 9/2003 | Isherwood et al. ..... 162/103 |
| 6,764,014 | B2 | 7/2004 | Lasch et al. |
| 2006/0127649 | A1 | 6/2006 | Keller et al. |
| 2008/0030020 | A1 | 2/2008 | Mallol et al. |
| 2008/0106725 | A1 | 5/2008 | Schuetzmann et al. |
| 2010/0276488 | A1 | 11/2010 | Camus |

FOREIGN PATENT DOCUMENTS

| | | | |
|---|---|---|---|
| DE | 42 35 184 | A1 | 4/1993 |
| EP | 0 229 645 | A1 | 7/1987 |
| EP | 0 549 284 | A1 | 6/1993 |
| EP | 0 773 320 | A1 | 5/1997 |
| EP | 1 120 737 | A1 | 8/2001 |
| EP | 1 122 360 | A1 | 8/2001 |
| EP | 1 335 217 | A2 | 8/2003 |
| EP | 1 536 064 | A1 | 6/2005 |
| FR | 2 871 174 | A1 | 12/2005 |
| GB | 2 250 473 | A | 6/1992 |
| GB | 2 306 178 | A | 4/1997 |
| WO | WO 90/13877 | | 11/1990 |
| WO | WO 94/20679 | A1 | 9/1994 |
| WO | WO 96/06220 | A1 | 2/1996 |
| WO | WO 01/57312 | A1 | 8/2001 |
| WO | WO 02/085642 | A2 | 10/2002 |
| WO | WO 2004/025337 | A1 | 3/2004 |
| WO | WO 2005/005727 | A1 | 1/2005 |
| WO | WO 2005/106118 | A1 | 11/2005 |
| WO | WO 2005/124022 | A2 | 12/2005 |

OTHER PUBLICATIONS

International Search Report mailed on Jun. 12, 2009 in International Patent Application No. PCT/FR2008/052387 (with translation).
International Search Report dated Aug. 20, 2009 from International Application No. PCT/FR2008/052335 (with English-language translation).
Written Opinion of the International Searching Authority dated Aug. 20, 2009 in International Application No. PCT/FR2008/052335 (with English-language translation).
Office Action dated Feb. 27, 2012 from U.S. Appl. No. 12/746,013.

* cited by examiner

*Primary Examiner* — Mark Halpern
(74) *Attorney, Agent, or Firm* — Oliff & Berridge, PLC

(57) ABSTRACT

A security paper comprising a fibrous substrate comprising a watermark having repeating motifs, and a security structure that does not completely cover the watermark and has at least one semi-reflective area which is superposed at least partly on the watermark; which paper on the one hand allows observation, through the semi-reflective area, at least partially, of one of the motifs, and on the other hand allows observation at least partially of another of said motifs in a region of the watermark that is not covered by the security structure.

19 Claims, 1 Drawing Sheet

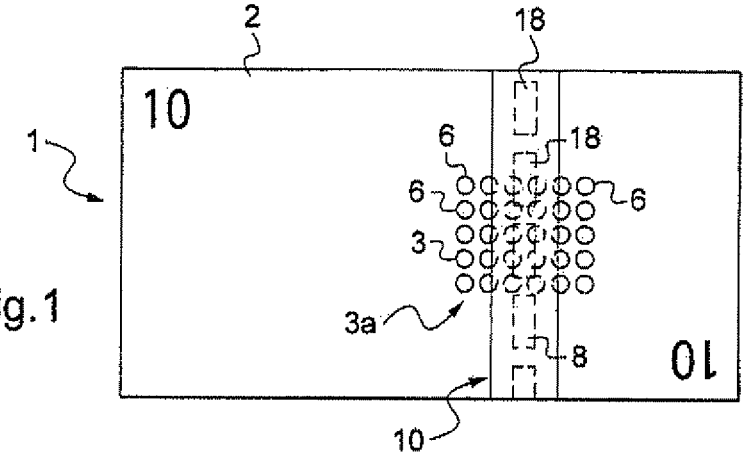
Fig.1
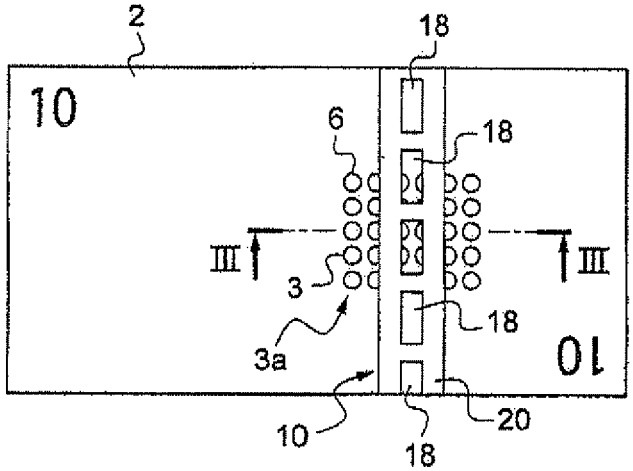
Fig.2
Fig.3
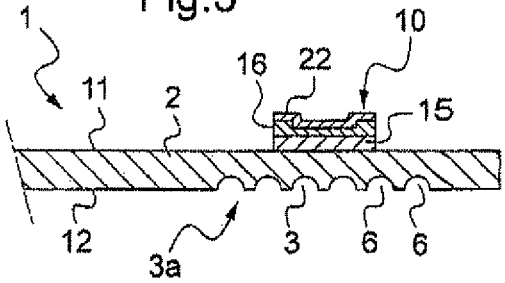
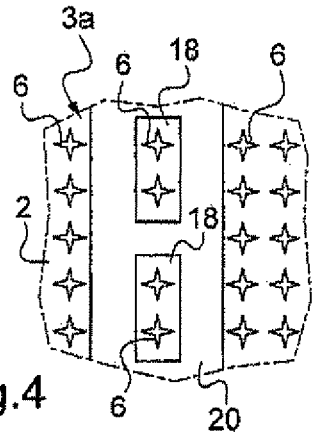
Fig.4

SECURITY PAPER

This application is a 371 of PCT/FR08/52387 filed 19 Dec. 2006

The present invention relates to security papers comprising a fibrous substrate including a watermark and a security structure.

In order to authenticate a paper document, a watermark is currently used.

This water mark may be a so-called dark watermark. Such a watermark is obtained during the manufacturing of the fibrous sheet by means of round forms or watermark rollers in the case of a Fourdrinier paper machine, including the intaglio engraved imprint of the watermark to be reproduced. A sheet is then obtained with a watermark which appears dark when the sheet is examined under transmitted light. The dark areas are due to an accumulation of fibers during the forming of the sheet, in the recessed parts of the watermarking means; thus, the thickness of the sheet and the density of the fibers are greater in these areas than in the remainder of the sheet.

So-called pale watermarks may be produced on a Fourdrinier machine by pressing a watermarking roller on the humid jet. The watermark is then obtained by raised portions of the watermarking roller, by simple displacement of the fibers locally reducing the material density and not by accumulation of fibers.

Imitations of real pale watermarks may be obtained by chemical methods consisting of locally transparentizing the medium 1. By adding a binder or resins filling the microporosities of the paper, the light may more easily pass through the medium, giving the aspect of a pale watermark as visible in transparence.

Other techniques also allow transparentization of a paper by local compression of the fibrous mat. These technologies are only tricks and may be differentiated from a real pale watermark stemming from displacement of fibers.

Application EP 1 122 360 discloses paper comprising at least one watermark with a multitone effect, including when it is observed in transmitted light, a set of pale areas arranged in the fashion of a screened image. The watermark may have more than two optical densities. The depth of the pale areas of the watermark is comprised for example between 50 and 90% of the total thickness of the paper.

European patent EP 1 252 389 B1 discloses a paper including a network of cells.

Application EP 0 773 320 A1 discloses a watermark cooperating with a security strip.

Application GB 2,250,473 discloses a security wire which may extend into a watermark.

Application FR 2 871 174 describes a support on which is deposited a semi-reflective coating.

Application WO 2005/106118 describes a substrate including a watermark covered by a security structure including metallized areas superposed to the watermark.

Application US 2006/0127649 describes a substrate including a watermark entirely covered on either side by a security structure.

There is a need for benefiting with security papers, used for example for making banknotes or other precious documents, from security features visible by the general public, easily recognizable and difficult to counterfeit.

The invention aims at meeting this need.

According to one of its aspects, the object of the invention is a security paper including:

a fibrous substrate including a watermark having patterns which are repeated, a security structure not entirely covering the watermark and including at least one semi-reflective area which is superposed at least partly to the watermark, the paper allowing at least partial observation of one of the repeated patterns through the semi-reflective area on the one hand and at least a partial observation of another one of said patterns in a region of the watermark not covered by the security structure.

Preferably, the size of the semi-reflective area is sufficient for allowing complete observation of at least one of said patterns and the size of the region of the watermark not covered by the security structure is also sufficient so as to allow complete observation of at least one other one of said patterns in this region.

By "semi-reflective", an at least partial reflection should be understood, which is preferably of the specular type, such as in a two-way mirror for example.

By means of the invention, the general public has a relatively inexpensive and easily recognizable means for authenticating the paper.

The observer may compare the watermark as it appears through the semi-reflective area(s) and as it appears in the region located out of the security structure.

The watermark advantageously has a pattern which is repeated, which is well identifiable by the general public, for example a pattern with a simple geometrical shape such as a circle, a polygon, a star, a logo, a text, for example at least one letter or figure.

The semi-reflective area(s) may have a contour of substantially the same shape as the pattern of the watermark which is repeated. This may provide an additional aesthetic effect.

The repeated patterns may be repeated with constant gap in at least one direction and be repeated in this direction for example for more than three times, better five times.

The watermark may be a watermark formed during the manufacturing of the substrate in a paper machine, preferably with a round form. The watermark may be a pale watermark as opposed to a dark watermark. A pale watermark is a watermark which appears paler than the remainder of the paper when it is observed in transparence, in daylight for example, stemming from a lower density of local material, which causes a local decrease in the opacity of the paper.

Preferably, the watermark is a watermark with a multitone effect, consisting of pale areas, i.e. areas with a smaller thickness than the thickness of the remainder of the sheet, arranged so as to form a screened pattern. Such screened watermarks are described in patent application EP 1122360. Such a watermark has the advantage of being particularly difficult to reproduce because of the fineness of its structure, while being very easily recognizable by the general public.

The security structure may extend from a first edge of the paper to a second edge opposed to the first, the security structure for example being a strip either with a constant width or not. The security strip may further be a patch. In an exemplary embodiment of the invention, the security structure has at least one opaque area which is at least partly superposed to the watermark. This opaque area may be reflective, by which a substantially plain bottom may be obtained when the security structure is observed in reflection, the semi-reflective area(s) only becoming apparent when viewed in transparence.

The opaque notably reflective area may be juxtaposed to the semi-reflective area, the opaque area for example completely surrounding the semi-reflective area.

The security structure may include a plurality of semi-reflective areas. The whole surface of a face of the structure may be reflective or semi-reflective.

The security structure may include transparent windows, for example made by cutting them out or demetallization.

The security structure may include a holographic layer, the latter for example extending over the whole of a face of the security structure, or include other security elements using the reflectivity of the structure, for example liquid crystals.

The semi-reflective area(s) and the reflective area(s) may be formed by a metal deposit with variable thickness, the metal for example being aluminium. The semi-reflective area (s) may define patterns which are either repeated at regular intervals or not, these patterns defining windows and/or texts.

The semi-reflective area(s) may have, with the remainder of the structure, when observed in transparence, a difference in optical density greater than 1, for example comprised between 5 and 80 units, as measured with a spectrophotometer (ISO 2471 standard, substrate backing), preferably 35-40 units.

The difference in opacity between the semi-reflective and opaque regions, when the structure is observed in transparence (examination of the transmitted light), may depend on how these regions are made, this difference in opacity being adjusted so as to provide an easily visible contrast by viewing them in transparence in daylight.

Other technologies for obtaining a material with reflectivity while being transparent or of low opacity, are known to one skilled in the art, such as for example the use of materials having a large difference in refractive index with their associated support (a polymeric film of the polyester type for example). This kind of materials is well-known for example in achieving transparent holographic security. For example these are metal salts of the general formula of type TiO(x) or such as zinc sulfide (ZnS). Iridescent pigments of the "Iriodin" type (produced by Merck) may also be used, while being aware that opacity depends on the amount of deposited pigments.

The security structure may include a support in a transparent thermoplastic material.

The security structure may be adhesively bonded to the fibrous substrate, for example by being positioned on the face of the substrate opposite to the watermark.

A further object of the invention, according to another of its aspects, is a document including a security paper as defined above.

A further object of the invention according to another one of its aspects, is a method for authenticating a security paper as defined above, including the step consisting of observing in transparence through the semi-reflective area, the watermark and of drawing a conclusion as to the authenticity of the paper, at least from the thereby observed image, notably by comparing the observed patterns of the watermark respectively without any superposition to the security structure and in superposition with at least one semi-reflective region.

The invention will be able to be better understood upon reading the detailed description which follows of exemplary non-limiting embodiments thereof, and upon examining the appended drawing, wherein:

FIG. 1 illustrates in a front view, an exemplary paper made according to the invention, being observed in reflection, FIG. 2 illustrates the paper of FIG. 1 when it is observed in transparence, FIG. 3 is a sectional view along III-III of FIG. 2, and FIG. 4 illustrates a partial front view of an alternative paper made according to the invention.

In the figures, the relative proportions of the different constitutive elements have not been observed and do not correspond to reality, for the sake of clarity.

The security paper 1 illustrated in FIGS. 1-3 includes a fibrous substrate 2 in which a watermark 3 is made by a known technique for making a watermark.

The fibrous substrate 2 for example includes paper-making fibers, notably cellulose fibers, and the watermark 3 is for example a pale watermark, being made with an intaglio relief in the thickness of the fibrous substrate, on a face 12 of the latter.

The watermark 3 may include a plurality of patterns 6 which are repeated, these patterns 6 having for example a simple geometrical shape, easily recognizable by the observer, for example a geometrical shape such as a circle, a polygon, a star, a logo, a letter or figure. The paper 1 includes a security structure 10 which for example is attached on the face 11 of the substrate 2 opposite to the one in which is made the watermark 3.

The security structure 10 includes a support 15, for example a translucent or transparent film, for example made in a thermoplastic film, such as a polyester film, PVC, PP, an aromatic polyamide or aramide, or other polymers, and a deposit 16 of variable thickness of a metal, of a metal alloy or oxide, for example of aluminium, copper, zinc, gold or platinum, the areas of smaller thickness defining semi-reflective areas 18 while the areas of larger thickness define opaque reflective areas 20.

The thickness of the metal in the semi-reflective areas 18 is sufficiently small in order to give the latter semi-reflectivity, allowing them to visible in transparence.

As an indication, the thickness of a semi-reflective thinned layer 18 is for example comprised between 5 and 50 nm, and the thickness of the deposit in the regions 20 is for example comprised between 100 and 300 nm.

In the illustrated example, the security structure includes a plurality of semi-reflective areas 18, which for example extend at regular intervals along the structure, for example as windows.

The semi-reflective areas 18 may have various shapes, for example with a polygonal contour, for example a rectangular contour as illustrated, or a circular contour or of shapes corresponding to text or to a logo or to any other pattern.

The invention is not particularly limited for obtaining semi-reflective 18 and opaque 20 regions, and a first reflective material, the opacity of which is sufficiently small for defining the semi-reflective region 18 and, of greater opacity at the locations 20, may for example be deposited on the support, a second reflective material may be deposited onto the first material. The first material is for example a metal such as aluminium and the second material is for example an oxide such as $TiO_x$, or ZnS, deposited in vacuo.

The semi-reflective areas 18 may further for example be made by means of an interferential pigment, for example of the platelet type, based on mica covered with titanium oxide or of the glass platelet type covered with titanium oxide, and the reflective areas 20 with higher opacity may be made by means of an ink, for example based on aluminium powder.

The security structure 10 may include a holographic layer 22 made by embossing a varnish deposited on the security structure, so as to generate a micro-relief intended to generate a hologram.

The holographic layer may be covered with a layer of protective varnish, if necessary.

Authentication of the paper 1 may be carried out by comparing the aspect of the paper observed in reflection with that observed in transparence.

In reflection, the reflective area(s) 20 and the semi-reflective area(s) 18 form a substantially reflective plain bottom which allows the color produced by the hologram to be observed. In reflection, the watermark 3 does not appear or is not very visible.

When viewed in transparence, the semi-reflective area(s) 18 allow the watermark 3 to be observed through them and the observer may compare the patterns 6 of the watermark which appear in the semi-reflective areas 18 and those which appear through the substrate 2 beside the security structure 10, in the region 3*a* of the watermark 3 not covered by the security structure.

In the alternative illustrated in FIG. 4, the semi-reflective areas 18 are sufficiently large for allowing entire observation of at least one pattern 6 of the watermark when viewed in transparence, in order to compare it with another pattern 6 in a region of the watermark 3 not covered by the structure 10.

The security structure 10 may have another form, not being limited to a strip, and may for example appear as a patch, such a patch being for example intended to be adhesively bonded on a face of the object to be secured, in a transparent or translucent region of the latter.

In the illustrated examples, the security structure 10 is positioned on face 11 of the substrate 2 opposite to the one on which the watermark 3 is made, but this may be different, and the watermark and the security structure may for example be on the same side.

Although a pale watermark is preferable, notably in order not to generate any overthickness in the paper, a dark watermark may also be used.

The expression "including one" should be understood as being a synonym of "including at least one", unless specified otherwise.

The invention claimed is:

1. A security paper comprising:

a fibrous substrate including a watermark having repeated patterns, and a security structure not covering entirely the watermark and including at least one semi-reflective area which is at least partly superposed to the watermark, the patterns of the watermark being repeated along at least a part of a longitudinal axis of the security structure, wherein at least a part of one of the patterns is capable of being viewed through the semi-reflective area, and at least a part of another one of the patterns in a region of the watermark not covered by the security structure is capable of being viewed.

2. The paper according to claim 1, the watermark comprising zones of reduced opacity.

3. The paper according to claim 1, the security structure extending from a first edge of the paper to a second edge, opposite to the first.

4. The paper according to claim 3, the security structure being a strip.

5. The paper according to claim 1, the security structure having at least one opaque area which is at least partly superposed to the watermark.

6. The paper according to claim 5, the opaque area being reflective.

7. The paper according to claim 6, the semi-reflective area and the reflective opaque area being formed by a metal deposit with variable thickness.

8. The paper according to claim 5, the opaque area being juxtaposed to the semi-reflective area.

9. The paper according to claim 8, the opaque area completely surrounding the semi-reflective area.

10. The paper according to claim 1, the security structure including a plurality of semi-reflective areas spaced apart.

11. The paper according to claim 1, wherein an entirety of at least one of said patterns is capable of being viewed through the semi-reflective area.

12. The paper according to claim 1, wherein an entirety of at least one of said patterns in a region of the watermark not covered by the security structure is capable of being viewed.

13. The paper according to claim 1, the security structure including a holographic layer.

14. The paper according to claim 1, wherein in the security structure, viewed in transmitted light in daylight, the semi-reflective area and the remainder of the security structure have an optical density difference greater than 1.

15. The paper according to claim 1, the security structure including a support in transparent thermoplastic material.

16. The paper according to claim 1, the security structure being adhesively bonded to the fibrous substrate.

17. The paper according to claim 1, the security structure being positioned on a face of the substrate opposite to the watermark.

18. A document including a security paper as defined in claim 1.

19. A method for authenticating a security paper as defined in claim 1, the method comprising viewing, in transmitted light, the patterns of the watermark through the semi-reflective area, and comparing the patterns of the watermark viewed through the semi-reflective area to patterns not viewed through the semi-reflective area, wherein the comparing of the patterns provides information as to the authenticity of the paper, and wherein the security paper is capable of being viewed in transmitted light in daylight.

* * * * *